US005119953A

United States Patent [19]

Atkeison, III et al.

[11] Patent Number: 5,119,953

[45] Date of Patent: Jun. 9, 1992

[54] PULP SUSPENSION SCREENING AND FRACTIONATION APPARATUS

[75] Inventors: Charles A. Atkeison, III, Norcross; Roland O. A. Fjällstrom, Lawrenceville, both of Ga.

[73] Assignee: Celleco Hedemora AB, Stockholm, Sweden

[21] Appl. No.: 503,031

[22] Filed: Apr. 2, 1990

[51] Int. Cl.[5] ..... D21D 5/00

[52] U.S. Cl. ..... 209/273; 209/240; 209/250; 210/415

[58] Field of Search ..... 209/273, 240, 246, 250, 209/306, 380, 270; 210/413–415; 162/55

[56] References Cited

U.S. PATENT DOCUMENTS

| | | | |
|---|---|---|---|
| 817,333 | 4/1906 | Orrman | 209/273 |
| 1,675,612 | 7/1928 | Laird | 209/270 |
| 1,697,875 | 1/1929 | Manning | 209/270 X |
| 3,508,651 | 4/1970 | Hooper | 210/415 X |
| 4,234,417 | 11/1980 | Gauld et al. | 209/273 X |
| 4,302,327 | 11/1981 | Martin | 209/273 X |
| 4,440,635 | 4/1984 | Reiniger | 209/306 X |
| 4,911,828 | 3/1990 | Musselmann et al. | 209/273 |
| 4,913,806 | 4/1990 | Hillström et al. | 209/273 |
| 4,941,970 | 7/1990 | Ans | 209/270 |

*Primary Examiner*—Donald T. Hajec
*Attorney, Agent, or Firm*—Davis Hoxie Faithfull & Hapgood

[57] ABSTRACT

An improved apparatus and process for fractionating pulp suspensions consists of multiple interchangeable modular treating compartments stacked atop one another. Pulp suspension is fractionated in the first compartment, and one of the two resulting fractions flows gravitationally to a second compartment where it is fractionated further. Any of the resulting fractions may be fractionated still further in subsequent compartments as many times as desired. The treating compartments are interchangeable, so removal, addition, or replacement of compartments is relatively easy and quick. Fractionation in each compartment is carried out through centrifugal force.

22 Claims, 6 Drawing Sheets

PULP SUSPENSION SCREENING AND FRACTIONATION APPARATUS

FIELD OF THE INVENTION

The present invention relates to a process and apparatus for screening and fractionating pulp suspensions.

BACKGROUND OF THE INVENTION

At some point in the process of creating paper from a pulp formed from wood or some other substance, it is often desirable to "screen" the pulp. This term is used to mean the filtration of the pulp to rid it of impurities and undesirable fibers. This screening is done by applying the aqueous pulp suspension or slurry against a screen or other filter device. The fiber that is considered acceptable for papermaking passes through the screen and the undesirable fiber is retained on the screen and rejected.

In addition to, or apart from screening, it is often desirable to fractionate pulp. "Fractionation" is used to mean the process by which pulp is sorted into different fiber lengths. The fractions of pulp resulting from fractionation each contain fibers of relatively uniform length. The process of fractionation is identical to that of screening, with one difference: in fractionation, the fibers are sorted by fiber characteristics, rather than accepted or rejected on the basis of desirability.

One way to categorize the screening/fractionation devices (hereinafter "fractionation devices") in the prior art is by the type of force used to pass the pulp suspension through the screen.

One class of fractionation devices uses the force of gravity by placing the pulp suspension on a screen and collecting the acceptable fiber beneath it.

Another class of fractionation devices uses centrifugal force to pass pulp suspension through the screen. A widely used device of this class may be described as follows: a cylindrical screen is used to filter pulp suspension, and a rotatable shaft is located coaxially through the screen. Attached to the rotatable shaft, extending radially, are one or more blades or foils, whose outer edges are very close to the screen. Pulp suspension is introduced into the cylinder defined by the screen and occupied by the rotatable shaft and blades or foils, and the shaft is rotated. As a result of this rotation, the blades or foils attached to the shaft move the suspension in a circular motion, creating a centrifugal force which pulls the pulp suspension outward. The blades or foils entrain the pulp away from the center of the separation chamber and press it against the screen, through which the smaller particles and fibers escape.

In addition to forcing smaller particles and fibers through the screen, the foils prevent longer fibers from escaping end-first, by the creation of a low-pressure area or "shear force" between the edge of the foils and the screen. This shear force has the effect of pulling any undesirable fibers escaping through the screen back toward the shaft. Since longer fibers require more time to escape than shorter ones, their escape is more likely to be interrupted by the passage of a blade or foil, and the consequent pulling effect of the shear force. As the frequency by which the foils pass a given point on the screen ("tip frequency") increases, the less likely it is for a longer fiber to escape successfully. The tip frequency can be altered either by varying the rotational speed of the shaft, or by varying the number of foils or blades on the shaft.

Multiple stages are often desirable in screening as well as in fractionation applications. "Series screening" is often used to more completely purify a pulp suspension. This process consists of screening the suspension through a plurality of similar or slightly dissimilar devices to ensure the complete removal of undesired elements. Multi-stage fractionation is used when more than two fractions are desired.

A need for improved multi-stage fractionation and screening devices ("multi-stage fractionation devices") has arisen with the development of new processes for producing paper pulp. These processes treat the fibers so that the fibers develop "fibrils," small spiral hairs or threads along the fibers' length.

Conventional multi-stage fractionation devices pump the slurry being treated from stage to stage. Such systems therefore require, between the stages, piping, a pump inlet box, a pump, and equipment for level regulation with an automatic valve at the pressure side of the pump. The mechanical working of the fiber, by pumping from one stage to another, causes some fibrils to come loose from the fibers, degrading the quality of the pulp. The more stages in which the pulp is treated, the more the quality of the pulp is degraded.

The loose fibrils themselves also negatively affect pulp quality. They, together with other small particles, form undesirable "fines," which degrade the quality of the pulp and reduce the capacity of subsequent treating machinery, e.g., dewatering equipment.

Conventional processing also reduces the capacity of dewatering equipment by introducing air, through the open inlet box of each pump, which mixes with the pulp.

Additionally, in conventional multi-stage fractionation devices it is difficult to remove, add, or replace stages. Such operations typically require long periods of "down time."

SUMMARY OF THE INVENTION

The apparatus of the present invention carries out multi-stage fractionation in a completely closed system, whose different stages can be easily replaced, added on to, or taken away. Gravity effects pulp transfer between interchangeable modular stages, supplemented by the action of the separating machinery. Inter-stage pumps are eliminated, avoiding undue mechanical working of the fiber and ensuring maintenance of pulp quality.

Specifically, in a principal aspect, the invention includes an apparatus for screening pulp comprising a housing, means forming a plurality of interchangeable modular compartments in the housing, screening means in each compartment dividing each compartment into an inner separation chamber and an outer filtrate chamber, inlet means for furnishing a pulp suspension to each separation chamber, a rotatable shaft extending through the separation chambers, entrainment means in each separation chamber attached to the shaft for entraining suspension furnished to said chamber during rotation of the shaft, and for causing a first fine fraction of the suspension to pass through the screening means, a coarse fraction outlet leading out of each compartment for discharging a coarse fraction from each separation chamber, a fine fraction outlet leading out of each filtrate chamber for discharging a fine fraction therefrom, and means connecting an outlet of one compartment to the inlet of another, for gravity transfer of suspension.

In another aspect, the invention includes a method for fractionating pulp suspensions which comprises furnishing a pulp slurry to a first separation chamber, forcing a first fine fraction of said slurry through a screen into a filtrate chamber, leaving a second, coarser fraction in said separation chamber, conveying, without substantial mechanical working of the pulp therein, at least one of said first and second fractions to a second separation chamber, and forcing a portion of the slurry in said second separation chamber through a second screen to form a third fraction, leaving a fourth fraction in said second separation chamber.

DETAILED DESCRIPTION OF THE INVENTION

Figure 1:
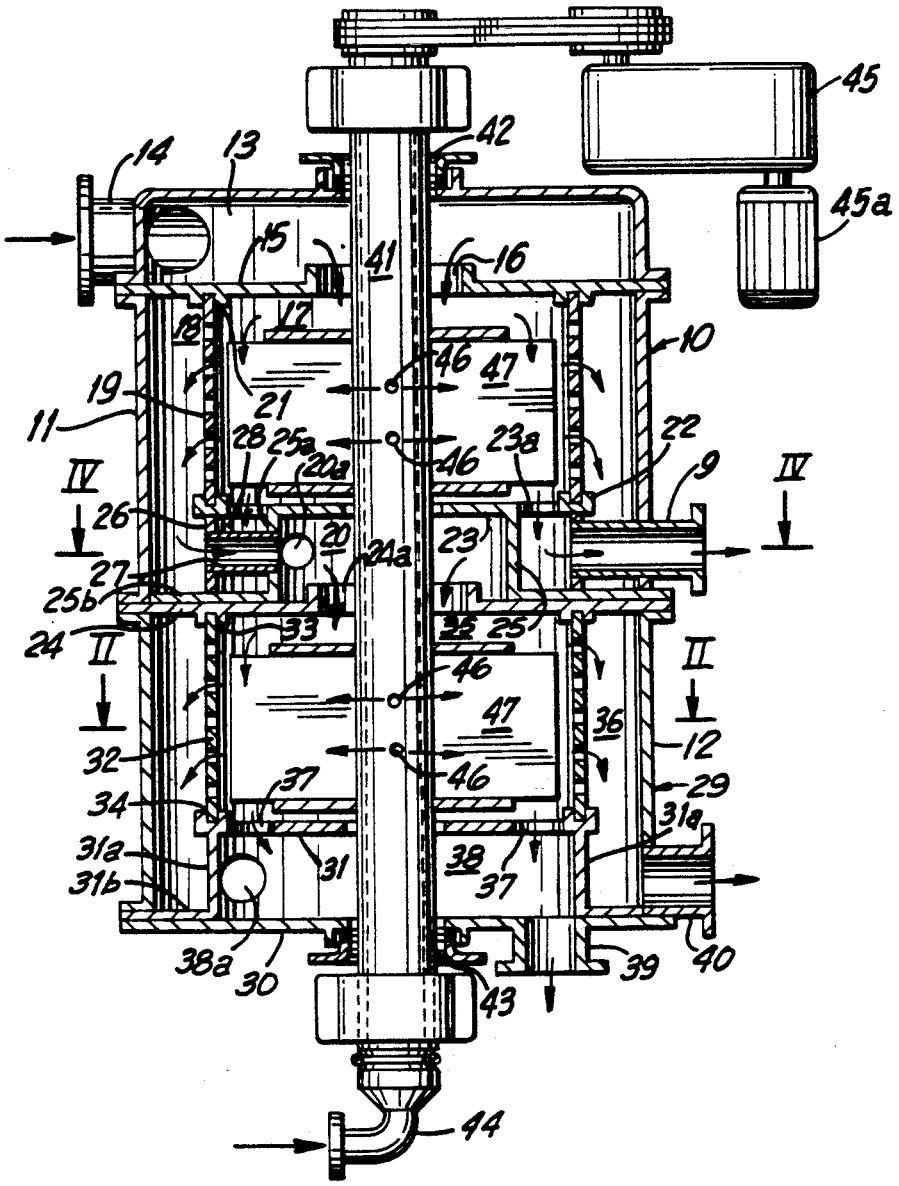
FIG. 1 is a vertical cross-section of a two-stage fractionation apparatus of the invention, in which the fine fraction from a first stage is treated further in a second stage.
Figure 2:
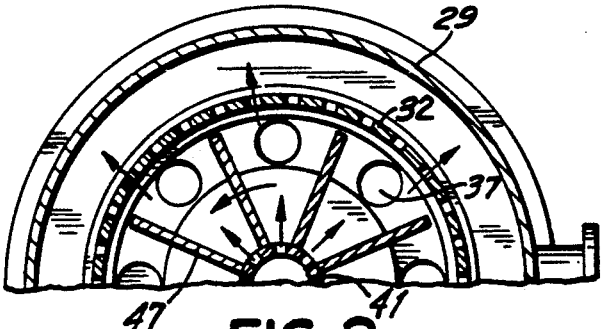
FIG. 2 is a horizontal cross-section taken along line II—II of FIG. 1, showing one half of the apparatus.
Figure 4:
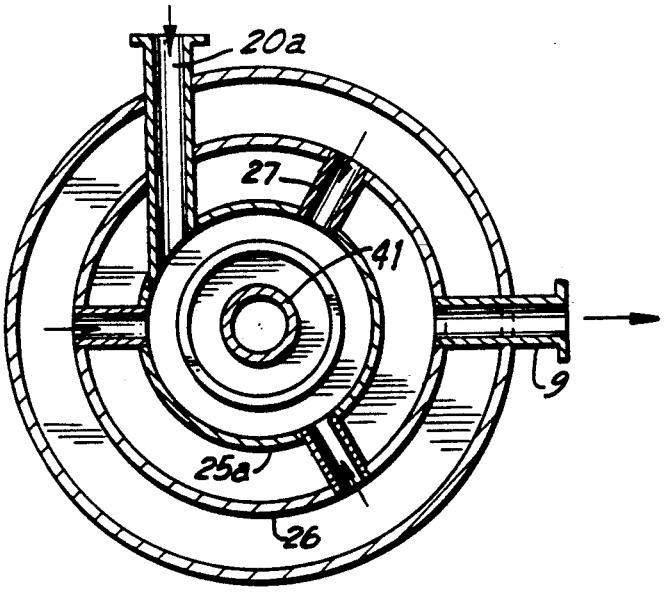
FIG. 4 is a horizontal cross-section taken along line IV—IV of FIG. 1.

Referring first to FIGS. 1, 2 and 4, a fractionation device according to the invention comprises a housing 10 forming two interchangeable modular treating compartments 11 and 12, the compartment 11 being placed directly above compartment 12. An inlet chamber 13 is positioned above the compartment 11 and a tangential inlet pipe 14 is provided for delivering a feed stream of pulp slurry to the inlet chamber 13.

Inlet chamber 13 is separated from compartment 11 by a plate 15. A central orifice 16 in plate 15 provides communication between inlet chamber 13 and compartment 11.

Compartment 11 is divided into a central separation chamber 17 and an annular filtrate chamber 18 by a cylindrical screen 19. Compartment 11 further includes a central connecting chamber 20 located at the bottom of the compartment. Screen 19 is seated in a circular channel 21 formed in the lower surface of the plate 15 and in a circular channel 22 formed in a plate 23 defining the bottom of separation chamber 17.

A plate 24 forms the bottom of compartment 11 and the top of compartment 12. A plate 25 having a central cylindrical crown **25*a* and a side flange 25*b* is positioned on plate 24 and with plate 23 forms the connecting chamber 20. A cylindrical sleeve 26 rests on the horizontal side flange 25*b* of plate 25 and supports plate 23. A duct 27 connects the filtrate chamber 18 with the connection chamber 20. A tangential inlet duct 20*a* (FIG. 4) leads into the connection chamber 20** for supplying diluent liquid thereto.

A series of holes **23*a* in plate 23 connect separation chamber 17 with the annular space 28 between the crown 25*a* of plate 25 and the sleeve 26. An outlet pipe 9** permits material from this annular space to be withdrawn from the device.

An orifice **24*a* in bottom plate 24 permits material from connecting chamber 20 to pass into the lower compartment 12**.

The compartment 12 is formed by the cylindrical wall 29 which extends downwardly toward a bottom plate 30. A hat shaped plate 31 having a crown section **31*a* and a flange section 31*b* is positioned at the bottom of compartment 12. Its flange section 31*b* lies on plate 30 and between plate 30 and the bottom of cylindrical wall 29**.

A cylindrical screen 32 is positioned in compartment 12 fitting into a channel 33 in the bottom of plate 24 and a channel 34 in the top of plate 31. The screen 32 divides the compartment 12 into a central separation chamber 35 and an outer annular filtrate chamber 36. Holes 37 are provided in plate 31 to connect the separation chamber 35 with a connecting chamber 38 formed inside the crown of hat shaped plate 31. An outlet 39 is provided in the bottom plate 30 for material in chamber 38. An outlet 40 is provided for the filtrate chamber 36. A tangential inlet duct **38*a* is provided for furnishing diluent liquid to chamber 38**.

A hollow shaft 41 is positioned to extend downwardly through the device from inlet chamber 13 through bottom plate 30. Bearings 42 and 43 in the top of inlet chamber 13 and bottom plate 30 accommodate the shaft 41 and packing (not shown) is provided on plates 23 and 31 to seal the passage of the shaft through those plates. An inlet 44 for water or other diluent liquid is provided at one end of the shaft 41 and drive means 45 including, for example, a motor **45*a* for rotating the shaft are also provided. Holes 46 along the length of the shaft permit liquid to be delivered to the separation chambers 17 and 35**.

It will be understood that the various elements described may be attached to another by welding or by bolts, as convenient. For simplicity these have not been shown in the drawing.

Attached to the shaft in each separation chamber 17 and 35, and rotatable with the shaft, are a plurality of entraining devices in the form of radially extending blades or foils 47.

In operation, a pulp slurry is supplied to inlet chamber 13 through inlet pipe 14. It passes via orifice 16 into separation chamber 17, the flow being entirely by gravity. In the separation chamber 17 diluting liquid may be furnished from shaft 41 via holes 46. Shaft 41 is rotated, giving the suspension in separation chamber 17 a relatively high rotational speed, generating centrifugal force on the fibers in the suspension. This, in conjunction with the low pressure zone between screen 19 and the edges of the foils 47, causes a volume of liquid and relatively fine particles to pass through screen 19 into filtrate chamber 18. The fine fraction so created flows from the filtrate chamber 17 via duct 27 into the connecting chamber 20. From chamber 20 the fine fraction leaves the first fractionation stage and is delivered, again by gravity, via orifice 24a into the separation chamber 35 of the second treating compartment 12.

A similar separation occurs in the second treating compartment 12. The finer components of the material from the first compartment are forced through screen 32, but in this case are received as a product through outlet 40.

The coarser fraction left behind in separation chamber 17 passes through holes 23a into annular space 28 and is removed through outlet 9. The coarser fraction in separation chamber 35 passes through holes 37 into connecting chamber 38 and is removed through outlet 39.

The device described in FIGS. 1, 2 and 4 thus permits the fractionation of a pulp stream into three fractions of varying degrees of fineness. The slurry being treated is moved from stage to stage without pumping and the mechanical working of the slurry which pumping entails. Moreover the modular construction of the assembly permits stages to be added or replaced with a minimum of disruption and effort.

Figure 3:
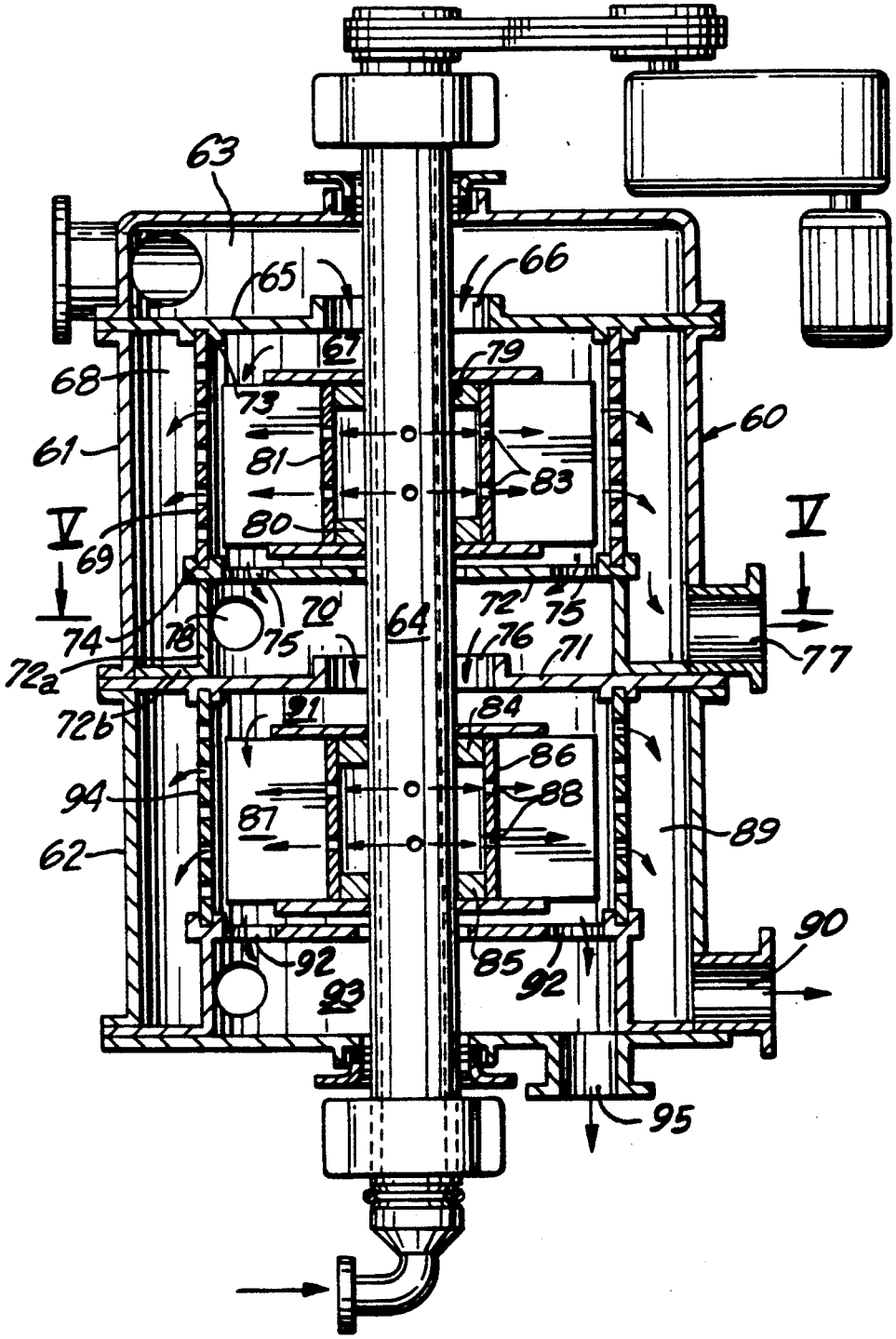
FIG. 3 is a vertical cross-section of a two-stage fractionation apparatus of the invention, in which the coarse fraction from a first stage is treated further in a second stage.
Figure 5:
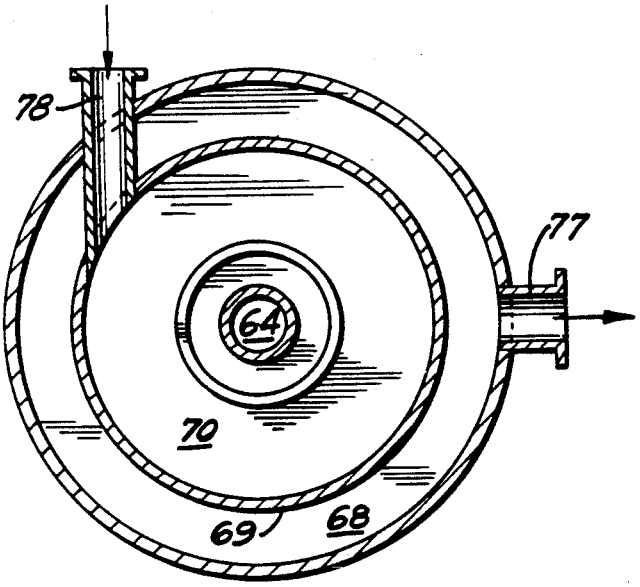
FIG. 5 is a horizontal cross-section taken along line V—V of FIG. 3.

Referring now to FIGS. 3 and 5, another fractionation device according to the invention comprises a housing 60, upper modular treating compartment 61, lower modular treating compartment 62, an inlet chamber 63, and a hollow shaft 64, all located in like manner to the analogous components described in FIG. 1.

The differences between the device described in FIGS. 3 and 5 and the device described in FIGS. 1, 2 and 4 lie in the general construction of compartment 61 and in the manner in which entraining devices are attached to the shaft 64.

In FIGS. 3 and 5, inlet chamber 63 is separated from compartment 61 by a plate 65. A central orifice 66 in plate 65 provides communication between inlet chamber 63 and compartment 61. Compartment 61 is divided into a central separation chamber 67 and an annular filtrate chamber 68 by a cylindrical screen 69. A plate 71 forms the bottom of compartment 61 and the top of compartment 62. A central connecting chamber 70, located at the bottom of compartment 61, is defined by plate 71, which forms its bottom, and a hat shaped plate 72 having a crown section 72a, which defines its top and sides. Plate 72 also has a flange section 72b which lies on plate 71.

Screen 69 is seated in a circular channel 73 formed in the lower surface of plate 65, and in a circular channel 74 formed in the top of section 72a of plate 72. Holes 75 are provided in plate 72 to connect the separation chamber 67 with the connecting chamber 70. An orifice 76 in bottom plate 71 permits material to pass from connecting chamber 70 into the lower compartment 62. An outlet 77 is provided for the filtrate chamber 68. A tangential inlet duct 78 is provided for furnishing diluent liquid to connecting chamber 70.

Lower compartment 62 comprises a cylindrical screen 94, a separation chamber 91, a filtrate chamber 89, a connecting chamber 93, an outlet 90 leading from filtrate chamber 89, and holes 92 providing communication between separation chamber 91 and connecting chamber 93, all situated in like manner as their analogous components in compartment 61. An outlet 95 leads from connecting chamber 93 to remove pulp slurry therefrom.

Extending from shaft 64 near the top of upper compartment 61 is a flange 79. A flange 80 extends from shaft 64 near the bottom of separation chamber 67. A cylindrical hub 81 is mounted on flanges 79 and 80, and is rotatable with shaft 64. Entraining devices in the form of radially extending blades or foils 82 are attached to hub 81 and are rotatable therewith.

Hub 81 contains holes 83 which permit liquid to be delivered to separation chamber 67.

Two flanges 84 and 85, a cylindrical hub 86, blades or foils 87, and holes 88 are located in lower compartment 62 in identical fashion to their analogous components in compartment 61.

The remainder of the device described in FIGS. 3 and 5 is identical to the device described in FIGS. 1, 2 and 4, and is likewise identical in operation, except for the flow of filtrate and residual slurry in upper compartment 61 (FIG. 3). After separation of the slurry in chamber 67, the fine fraction in filtrate chamber 68 is removed from the device through outlet 77. The coarse fraction left in separation chamber 67 flows through holes 75 into connecting chamber 70, and is supplied with diluent liquid from inlet duct 78.

From chamber 70, the coarse fraction passes through orifice 76 into lower compartment 62, where it undergoes a further separation. The fine fraction resulting from this separation is removed from filtrate chamber 89 via outlet 90. The coarse fraction left in separation chamber 91 passes through holes 92 into connecting chamber 93 and thence out of the device through outlet 95.

The device described in FIGS. 3 and 5 thus produces from a pulp slurry three fractions of varying fineness, the second stage fractionating the coarse fraction of the first stage.

Figure 6:
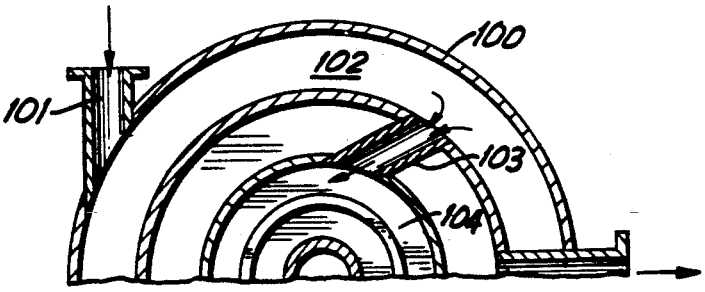
FIG. 6 is a horizontal cross-section of a modification of the embodiment shown in FIG. 4, showing one half of the apparatus.

Referring now to FIG. 6, an interchangeable modular treating compartment according to the invention includes a housing 100, a tangential inlet duct 101 leading into a filtrate chamber 102 for supplying diluent liquid thereto, and a duct 103, substantially tangential to a connecting chamber 104, which connects the filtrate chamber 102 with the connection chamber 104.

The compartment described in FIG. 6 is identical to the compartment described in FIG. 4, except that duct 103 (FIG. 6) leads tangentially from filtrate chamber 102 to connecting chamber 104, and inlet duct 101 leads into filtrate chamber 102 instead of into connecting chamber 104.

In operation, a fine fraction of pulp slurry in filtrate chamber 102 is supplied with diluent liquid via inlet duct 101. Since duct 101 is tangential, the diluent liquid supplied tends to move the pulp slurry in a circular motion. The slurry enters chamber 104 via duct 103, which is tangentially oriented to accommodate and take advantage of the circular motion of the slurry. Since diluent liquid has already been supplied to the fine fraction slurry via inlet duct 101, no inlet duct leads into connecting chamber 104. In all other ways, the compartment described in FIG. 6 operates identically to the compartment of FIG. 4.

Figure 7:
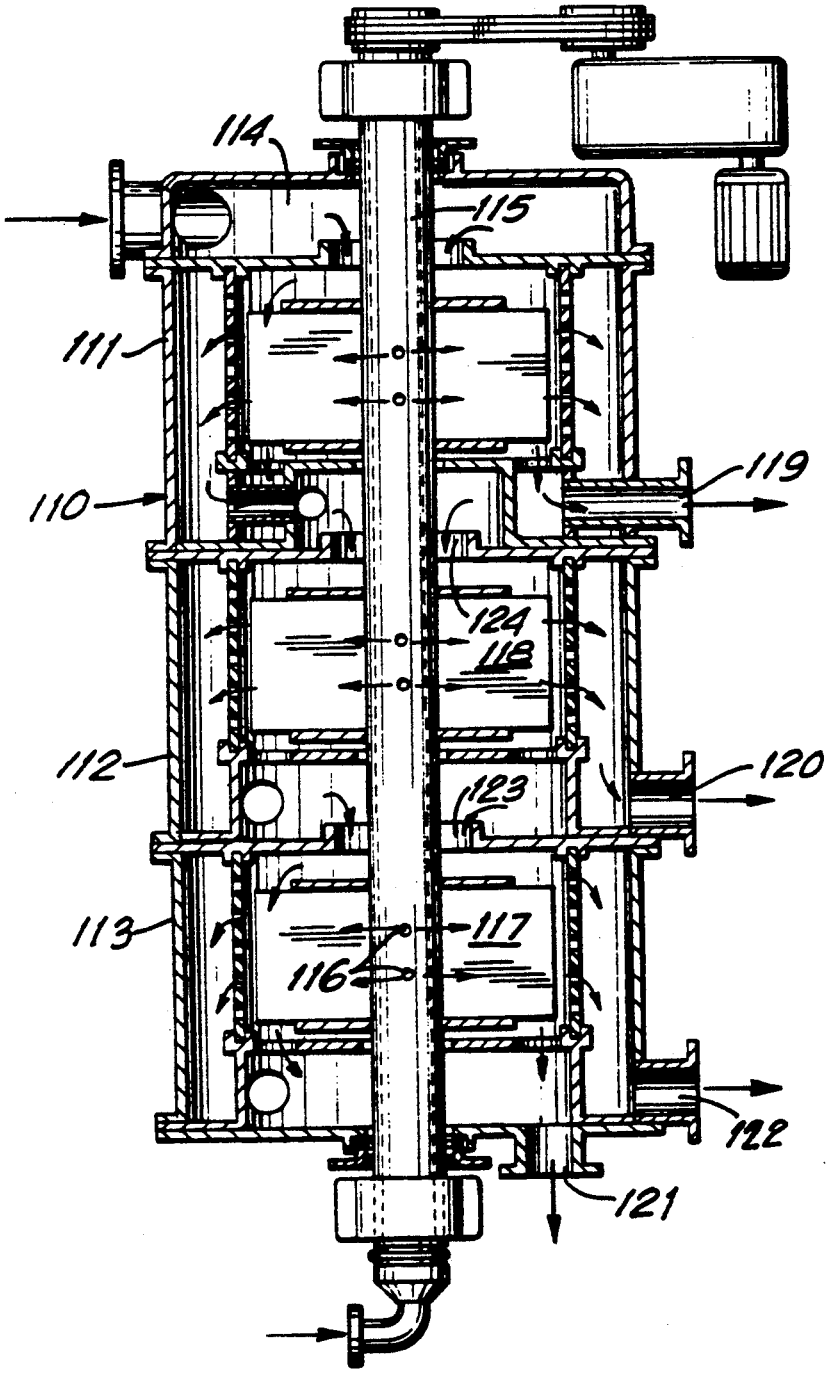
FIG. 7 is a vertical cross-section of an apparatus of the invention which includes three fractionation stages, the second stage of which treats the fine fraction from the first stage, and the third stage of which treats the coarse fraction from the second stage.

Referring now to FIG. 7, another fractionation device according to the invention comprises a housing 110 forming three interchangeable modular treating compartments 111, 112 and 113, compartment 111 being placed directly above compartment 112, and compartment 112 being placed directly above compartment 113. An inlet chamber 114, of identical construction to inlet chamber 13 (FIG. 1), is positioned above compartment 111. A hollow shaft 115 is positioned to extend downwardly through the device from inlet chamber 114 through compartment 113. Hollow shaft 115 is of identical construction to hollow shaft 41 (FIG. 1), except that the former is longer by the height of compartment 113, contains holes 116 to permit liquid to be delivered to compartment 113, and has attached to it a plurality of additional foils 117 which extend into compartment 113.

Compartment 111 is of identical construction to compartment 11 (FIG. 1). Compartment 113 is of identical construction to compartment 12 (FIG. 1). Compartment 112 is of identical construction to compartment 61 (FIG. 3), except that foils 118 in compartment 112 are not mounted upon a hub, but are directly attached to shaft 115.

The device described in FIG. 7 operates similarly to the device described in FIG. 1, except that the former includes an additional fractionation stage. Pulp slurry entering through inlet chamber 114 is separated in compartment 111, the coarser fraction exiting the device through an outlet pipe 119. The finer fraction flows into compartment 112 via an orifice 124, where it undergoes further separation. The finer fraction from the second-stage separation is removed through an outlet pipe 120. The coarser fraction from the second-stage separation flows via an orifice 123 into compartment 113 where it undergoes a third separation. The coarser fraction resulting from the third-stage separation is removed from the device through an outlet pipe 121, and the finer fraction is removed through an outlet pipe 122.

The device described in FIG. 7 thus permits the fractionation of a pulp stream into four fractions of varying degrees of fineness.

Figure 8:
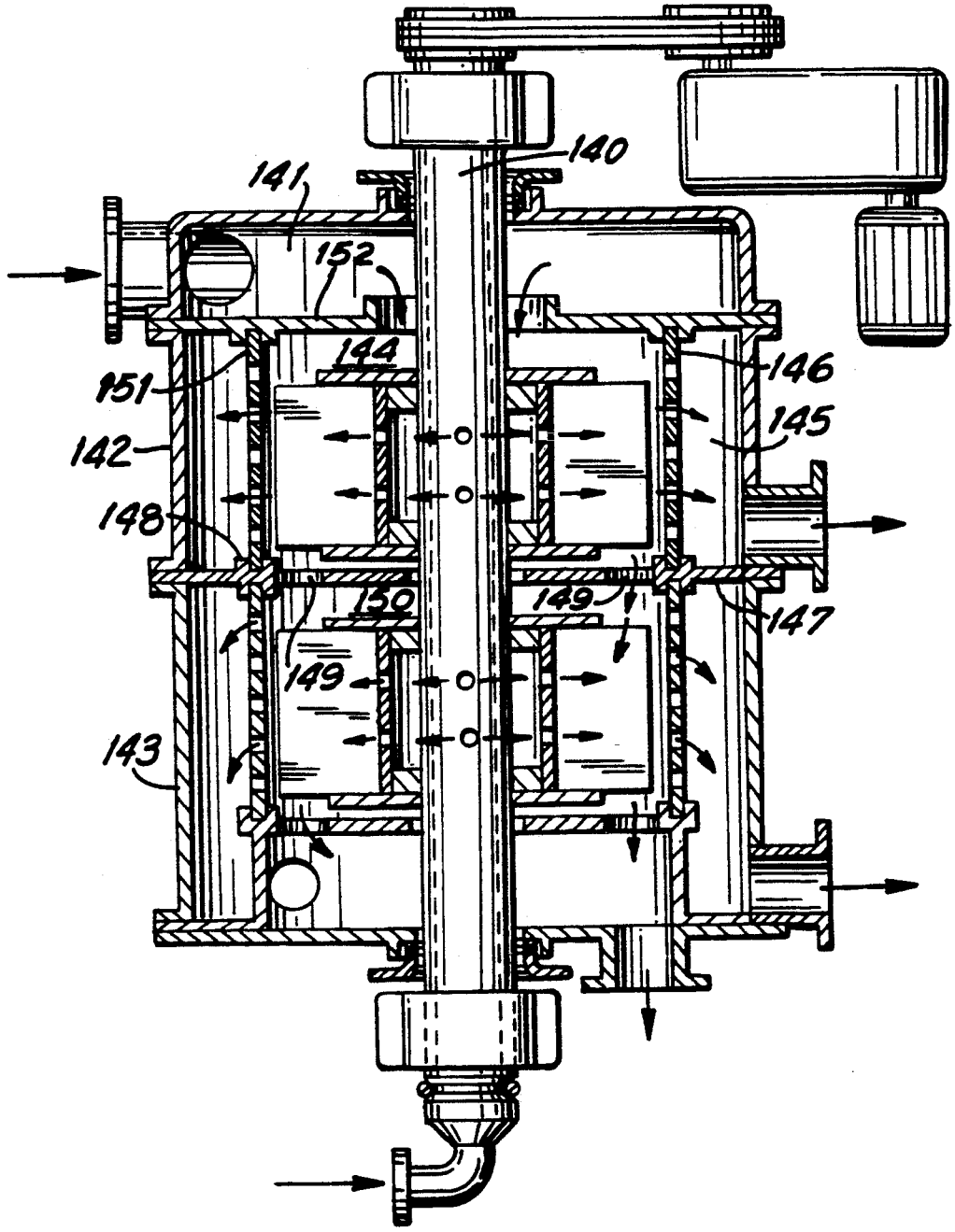
FIG. 8 is a vertical cross-section of a modification of the embodiment shown in FIG. 3.

Referring now to FIG. 8, another fractionation device according to the invention comprises a hollow shaft 140, an inlet chamber 141, an upper modular treating compartment 142, and a lower modular treating compartment 143, all situated in like manner to the analogous components of the device described in FIG. 2. Inlet chamber 141 is identical to inlet chamber 63 (FIG. 3). Compartment 143 is identical to compartment 62 (FIG. 3). Shaft 140 is identical to shaft 64 (FIG. 3), except that the former is slightly shorter than the latter, since upper compartment 142 lacks a central connecting chamber.

Compartment 142 is divided into a central separation chamber 144 and an outer annular filtrate chamber 145 by a cylindrical screen 146. A plate 147 defines the bottom of compartment 142, separation chamber 144, and filtrate chamber 145. The screen 146 is fixed into position at its bottom by a circular channel 148 formed in the top of plate 147, and at its top by a circular channel 151 found in the bottom of a plate 152, which forms the top of compartment 142.

A plurality of holes 149 in bottom plate 147 connect separation chamber 144 to a separation chamber 150 in compartment 143.

In all other respects, the device described in FIG. 8 is identical to the device described in FIG. 3. The two devices are likewise identical in operation, except that the coarser fraction of slurry from upper compartment 142 (FIG. 8) leaves separation chamber 144 via holes 149 and enters directly into separation chamber 150, without passing through an intermediate central connecting chamber.

Figure 9:
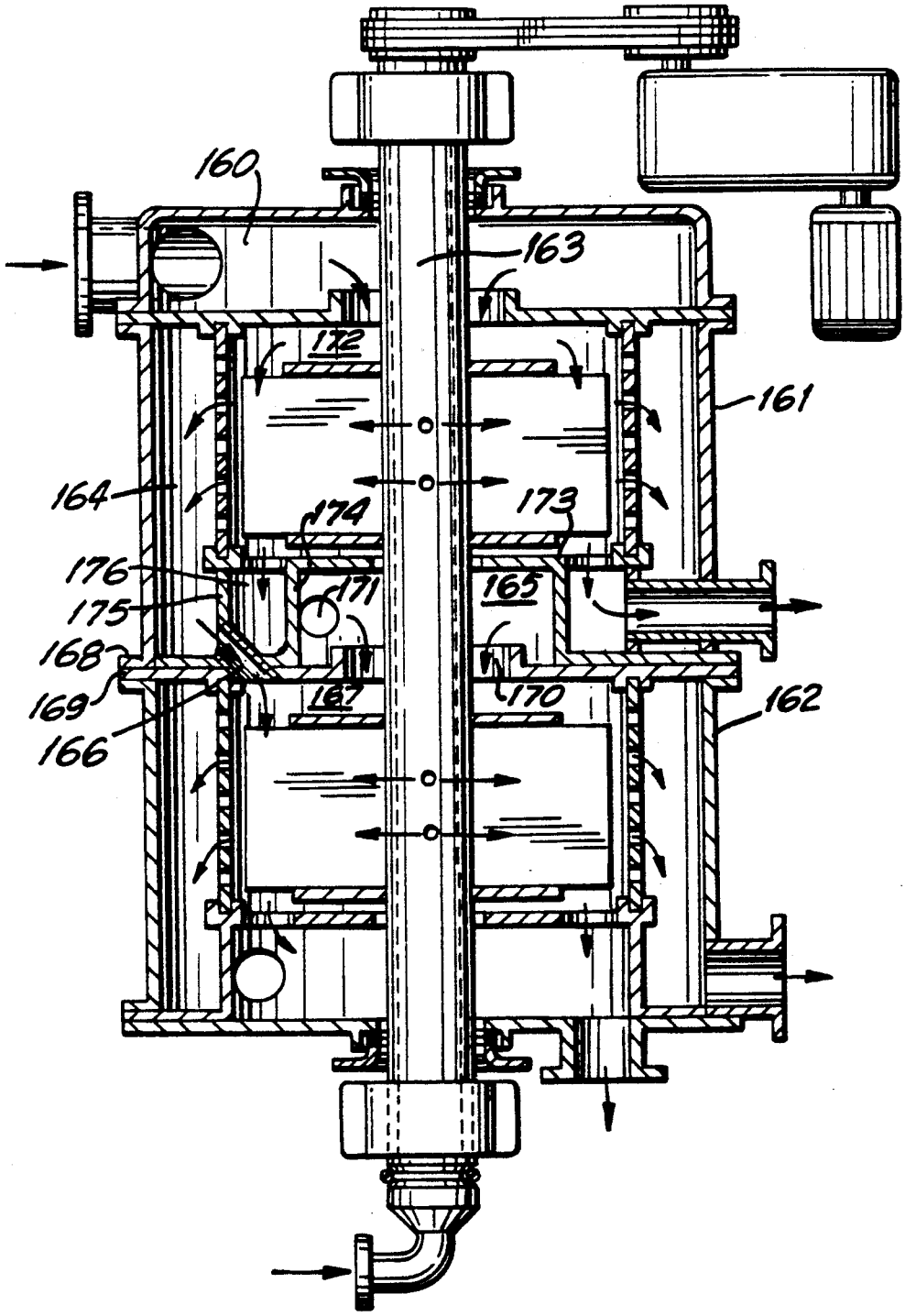
FIG. 9 is a vertical cross-section of a modification of the embodiment shown in FIG. 1.

Referring now to FIG. 9, another fractionation device according to the invention comprises an inlet chamber 160, an upper modular treating compartment 161, a lower modular treating compartment 162, and a hollow shaft 163.

Upper compartment 161 contains a filtrate chamber 164, a separation chamber 172, and a central connecting chamber 165, all located in like manner to the analogous components of compartment 11 (FIG. 1). A plate 169 forms the bottom of compartment 161 and central connecting chamber 165. The top of connecting chamber 165 is formed by a plate 173, which also forms the bottom of separation chamber 172. The sides of connecting chamber 165 are formed by a cylindrical plate 174. A flange 168 extends from the bottom of plate 174, and lies on bottom plate 169. A cylindrical sleeve 175 is situated outside of and concentrically to plate 174, forming an annular space 176 between the plates. Sleeve 175 rests on flange 168.

A diagonally oriented duct 166 connects filtrate chamber 164 to a separation chamber 167 of lower compartment 162, passing through flange 168, a bottom plate 169, and sleeve 175. Unlike compartment 11 (FIG. 1), no duct exists to connect filtrate chamber 164 to connecting chamber 165.

In all other respects, the device described in FIG. 9 is identical to the device described in FIGS. 1, 2, and 4. It's operation is likewise identical, except that the fine fraction of slurry in filtrate chamber 164 (FIG. 9) does not enter connecting chamber 165. Rather, it directly enters separation chamber 167 of lower compartment 163 via diagonal duct 166. Connecting chamber 165 performs the sole function of supplying diluent liquid to separation chamber 167 via an orifice 170 in bottom plate 169. Diluent liquid is supplied to connecting chamber 165 via a tangential inlet duct 171.

Given the interchangeable nature of the compartments, it will be readily appreciated that other combinations of the different fractionation stages are encompassed by the invention.

The different stages, although preferably placed directly one on top of the other, may be placed in other positions, so long as subsequent stages are placed at sufficiently lower levels than preceding stages to ensure gravitational flow of slurry from one stage to another.

We claim:

1. An apparatus for screening pulp suspensions comprising:

a housing, means forming a plurality of compartments one above the other in the housing, screening means in each compartment positioned so as to divide each compartment into an inner separation chamber and an outer filtrate chamber, inlet means for furnishing a pulp suspension to each separation chamber, a rotatable shaft extending through the separation chambers, means attached to the rotatable shaft for entraining suspension in each separation chamber during rotation of the shaft, and for causing a fine fraction of the suspension to pass through the screening means of each compartment, a coarse fraction outlet leading out of each filtrate chamber, for discharging a fine fraction of the suspension therefrom, a fine fraction outlet leading out of each filtrate chamber, for discharging a fine fraction of the suspension therefrom, a substantially cylindrical connecting chamber, comprising a flat bottom, a circular side wall, and a flat top, disposed in each compartment beneath the inner separation chamber of each compartment, at least one connecting chamber being constructed to receive a fraction of said pulp suspension from a coarse fraction outlet and at least one connection chamber being constructed to receive a fine fraction from a fine fraction outlet, a connecting chamber outlet leading from each said connecting chamber, and means connecting the connecting chamber outlet of one compartment to the inlet means of another, for gravity transfer of suspension.

2. The apparatus of claim 1 wherein the screening means is tubular, the inner separation chamber is cylindrical, and the outer filtrate chamber is annular.

3. The apparatus of claim 1 wherein the inlet means for supplying suspension and the coarse fraction outlet are located at approximately opposite ends of each compartment.

4. The apparatus of claim 1 wherein the rotatable shaft is hollow and has a plurality of holes, at least one hole communicating with each compartment to provide diluent liquid to the suspension in the separation chamber.

5. The apparatus of claim 1 wherein the means connecting the outlet of the connection chamber of one compartment to the inlet means of another includes means for the delivery of a diluent liquid.

6. The apparatus claimed in claim 1 and comprising an inlet chamber, means for supplying a pulp suspension to said inlet chamber and means for conveying pulp from said inlet chamber to the separation chamber of a compartment.

7. The apparatus of claim 1 wherein there is an upper and lower compartment, and wherein said rotatable shaft has a flange in said upper compartment and a flange in said lower compartment, and a hub mounted on each flange, said means for entraining suspension being attached to the hubs.

8. The apparatus of claim 1, wherein there is an upper compartment, a middle compartment, and a lower compartment, and further comprising means for supplying diluent to the connecting chamber of said upper compartment.

9. An apparatus for screening pulp suspension, comprising:

an upper compartment;

a lower compartment disposed beneath said upper compartment;

a screen disposed in each of said compartments which divides each of said compartments into an inner separation chamber and an outer filtrate chamber;

inlet means for furnishing said pulp suspension to the separation chamber of said first compartment;

a rotatable shaft extending through both of said compartments;

means attached to said rotatable shaft for entraining said pulp suspension in the separation chambers of each of said compartments, and for causing a fine fraction of said suspension to pass through said screen in each compartment;

a connecting chamber disposed in said upper compartment below the separation chamber of said upper compartment;

a space disposed in said upper compartment below the separation chamber of said upper compartment, and between said connecting chamber and the filtrate chamber of said upper compartment;

a first outlet leading from the filtrate chamber of said upper compartment through said space to said connecting chamber for the delivery of a fine fraction of said pulp suspension;

a second outlet leading from the separation chamber of said upper compartment to said space for the delivery of a coarse fraction of said pulp suspension;

a third outlet leading from said connecting chamber to the separation chamber of said second compartment; and a fourth outlet leading from said space through said filtrate chamber out of said first compartment.

10. The apparatus claimed in claim 9 wherein said connecting chamber is substantially cylindrical and wherein said space is substantially annular.

11. The apparatus claimed in claim 9 wherein said lower compartment has a second connecting chamber and means for conveying coarse fraction from the separation chamber of said lower compartment to said second connecting chamber.

12. The apparatus claimed in claim 11 and comprising means for supplying diluent liquid to said second connecting chamber.

13. The apparatus of claim 9, further comprising a inlet duct leading to and substantially tangential to the filtrate chamber of said upper compartment for delivery of diluent liquid thereto, and wherein said first outlet is substantially tangential to said connecting chamber.

14. The apparatus of claim 9, further comprising a direct passage from the filtrate chamber of said upper compartment to the separation chamber of said lower compartment.

15. An apparatus for screening pulp suspension, comprising:

an upper compartment;

a lower compartment disposed beneath said upper compartment;

a screen disposed in each of said compartments which divides each of said compartments into an inner separation chamber and an outer filtrate chamber;

inlet means for furnishing said pulp suspension to the separation chamber of said first compartment;

a rotatable shaft extending through both of said compartments;

means attached to said rotatable shaft for entraining said pulp suspension in the separation chambers of each of said compartments, and for causing a fine fraction of said suspension to pass through said screen in each compartment;

a substantially cylindrical connecting chamber comprising a flat bottom, substantially circular side wall, and flat top, disposed in said upper compartment below the separation chamber of said upper compartment;

a first outlet leading from the separation chamber of said first compartment through the top of said connecting chamber into said connecting chamber for the delivery of a coarse fraction of said pulp suspension;

a second outlet leading from the filtrate chamber of said upper compartment to outside of said upper compartment;

a third outlet, being annular and extending coaxially to said rotatable shaft along its entire length from said connecting chamber to the separation chamber of said lower compartment.

16. The apparatus claimed in claim 15 and including means for supplying diluent liquid to said connecting chamber.

17. A modular compartment for use in an apparatus for screening pulp suspension comprising:

cylindrical screening means positioned so as to divide the compartment into an inner separation chamber and an outer filtrate chamber, inlet means for furnishing a pulp suspension to the separation chamber, a rotatable shaft extending through the separation chamber, substantially coaxial with the screening means, means attached to the rotatable shaft for entraining suspension in the separation chamber during rotation of the shaft, and for causing a fine fraction of the suspension to pass through the screening means of the compartment, a cylindrical connection chamber, comprising a flat bottom, a circular side wall and a flat top disposed beneath said separation chamber, a coarse fraction outlet comprising a plurality of circular holes in the top of said connecting chamber for conveying a coarse fraction of the suspension from said separation chamber to said connecting chamber, and a fine fraction outlet leading out of the filtrate chamber, for discharging a fine fraction of the suspension therefrom.

18. The modular compartment of claim 17, further comprising means for supplying diluent to said connecting chamber.

19. The modular compartment of claim 17, wherein the rotatable shaft has a flange having a hub mounted thereon, said means for entraining suspension being attached to the hub.

20. The apparatus of claim 17, wherein said modular compartment is adapted to be placed in series with similarly constructed compartments to form a multistage pulp suspension screening apparatus.

21. A modular compartment for use in an apparatus for screening pulp suspension comprising:

cylindrical screening means positioned so as to divide the compartment into an inner separation chamber and an outer filtrate chamber, inlet means for furnishing a pulp suspension to the separation chamber, a rotatable shaft extending through the separation chamber, substantially coaxial with the screening means, means attached to the rotatable shaft for entraining suspension in the separation chamber during rotation of the shaft, and for causing a fine fraction of the suspension to pass through the screening means of the compartment, a coarse fraction outlet leading out of the separation chamber for discharging a coarse fraction of the suspension thereform, a fine fraction outlet leading out of the filtrate chamber for discharging a fine fraction of the suspension therefrom, a cylindrical connecting chamber, comprising a flat bottom, a circular side wall, and a flat top, disposed beneath said separation chamber, and an annular space comprising a flat bottom, a flat top and circular side walls disposed beneath said separation chamber and between said filtrate chamber and said connecting chamber, said coarse fraction outlet comprising a plurality of circular holes on the top of said annular space for conveying coarse fraction from said separation chamber to said connecting chamber, and said fine fraction outlet comprising a duct leading from said filtrate chamber through said annular space to said connecting chamber.

22. The modular compartment of claim 21, wherein said duct leading from said filtrate chamber through said annular space to said connecting chamber is substantially tangential to said connecting chamber, and further comprising a duct for supplying diluent liquid to said filtrate chamber which is substantially tangential to said filtrate chamber.

* * * * *

UNITED STATES PATENT AND TRADEMARK OFFICE

CERTIFICATE OF CORRECTION

PATENT NO. : 5,119,953

DATED : June 9, 1992

INVENTOR(S) : Charles A. Atkeison, III & Roland O.A. Fjallstrom

It is certified that error appears in the above-identified patent and that said Letters Patent is hereby corrected as shown below:

Claim 1 (col. 8, line 57), "filtrate" should be --separation--.

(col. 8, line 58), "fine" should be --coarse--.

(col. 9, line 1), "connection" should be --connecting--.

Claim 17 (col. 11, line 16), "connection" should be --connecting--.

Signed and Sealed this

Third Day of August, 1993

*Attest:*

Michael K. Kirk

MICHAEL K. KIRK

*Attesting Officer*

*Acting Commissioner of Patents and Trademarks*